US006753505B2

(12) United States Patent
Keller

(10) Patent No.: US 6,753,505 B2
(45) Date of Patent: Jun. 22, 2004

(54) GLOW PLUGS AND A METHOD OF PRODUCING GLOW PLUGS

(75) Inventor: Paul Keller, Bietigheim (DE)

(73) Assignee: Beru AG, Ludwigsburg (DE)

( * ) Notice: Subject to any disclaimer, the term of this patent is extended or adjusted under 35 U.S.C. 154(b) by 25 days.

(21) Appl. No.: 10/200,591

(22) Filed: Jul. 23, 2002

(65) Prior Publication Data

US 2003/0034343 A1 Feb. 20, 2003

(30) Foreign Application Priority Data

Jul. 23, 2001 (DE) ..... 101 34 956

(51) Int. Cl.[7] ..... F23Q 7/22
(52) U.S. Cl. ..... 219/270; 72/267; 123/145 A
(58) Field of Search ..... 219/220; 123/145 A; 29/611; 72/76, 333, 267

(56) References Cited

U.S. PATENT DOCUMENTS 4,321,816 A * 3/1982 Nakahara et al. ..... 72/267
5,036,691 A * 8/1991 Binhack et al. ..... 72/76
5,088,311 A * 2/1992 Inoue ..... 72/333
5,251,589 A * 10/1993 Duba et al. ..... 123/145 A
5,304,778 A * 4/1994 Dasgupta ..... 219/270

FOREIGN PATENT DOCUMENTS

| | | | | |
|---|---|---|---|---|
| DE | 89 09 893.5 U1 | | 2/1991 | |
| EP | 0 324 627 A2 | | 7/1989 | |
| EP | 0 438 097 A1 | | 7/1991 | |
| JP | 2000-111048 | | 4/2000 | |
| JP | 2002192417 | * | 7/2002 | ..... B23D/1/06 |

* cited by examiner

*Primary Examiner*—Ehud Gartenberg
*Assistant Examiner*—L Fastovsky
(74) *Attorney, Agent, or Firm*—Nixon Peabody LLP; David S. Safran

(57) ABSTRACT

A method of producing a glow plug including a glow tube (5) with internal heating coil (4) and optionally regulating coils which are embedded therein using a ceramic filling, whereby a compaction of an area on a combustion chamber side of the glow tube (5) is performed using a recessing-reducing process with a radial feed.

3 Claims, 5 Drawing Sheets

GLOW PLUGS AND A METHOD OF PRODUCING GLOW PLUGS

BACKGROUND OF THE INVENTION

1. Field of the Invention

The invention relates to glow plugs and a method for the production of glow plugs.

2. Description of the Related Art

As shown in FIGS. 1, 2(*a*) & 2(*b*), a conventional glow plug has a glow tube 5 without additional tapering and without additional compaction of the glow rod tip. The glow tube 5 has an internal heating coil 4 which is embedded therein using a ceramic filling 3. At the tip of glow tube 5 on the combustion chamber side, the heating coil 4 is connected with the glow tube 5 by welding 6. At the opposite end of the glow tube 5, the heating coil 4 is connected with a connection pole 1. The front area 5*a* on the combustion chamber side of glow tube 5 is reduced cylindrically according to the known feed method.

As shown in FIGS. 3(*a*) & 3(*b*), in order to improve the compaction in the area of the combustion chamber side of the glow tube, the area 5*a* above the tip of the glow tube 5 is reduced from diameter D1 to diameter D2. In particular, at the glow tube tip 5*a*, the area is reduced using a so-called feed process whereby either continuous cylinders or a linear taper towards the tip of the heating rod are obtained. With this process, the glow rod is inserted into a swaging tool having a lead-in inclined area whereby the diameter is reduced by the swaging process and the axial feed of the glow tube.

The reduction in diameter that results in using the feed process, however, leads to unsatisfactory compaction precisely in the critical area directly behind the welding of the heating coil and the glow tube tip. Equally, there is little opportunity for more complex shapes of the glow tube area on the combustion chamber side, which influence glow behavior, glow distribution and the life of the glow plugs, or expansion of new possibilities for glow plug applications.

SUMMARY OF THE INVENTION

An object of the invention is to enhance the compaction in the glow tube tip while avoiding the disadvantages of the related art. In this regard, a new shaping of the tip area of the glow tube expands new possibilities for applications, in particular, the possibility of fitting other components.

The object of the invention may be achieved using a method for producing glow plugs having an internal heating coil and optionally regulating coils that are embedded in an annular space of the glow using a ceramic filling, whereby a compaction of the area on the combustion chamber side of the glow tube is performed using a recessing-reducing process with an radial feed. The recessing-reducing process is performed using a recessing tool having a pair of tool elements or stamps with stamping faces that have several zones that are arranged at an angle relative to one another. Alternatively, the stamping faces may be curved in a convex and/or concave manner. Moreover, the area on the combustion chamber side of the glow tube has band-shaped or groove-shaped neck.

Accordingly, the method and apparatus in accordance with the invention are advantageous since they result in a compaction or deformation by way of the recessing-reducing process whereby the glow tube is positioned in the recessing tool so that the stamps act radially on the glow tube and compact the glow tube to the desired diameter. As a result, a more uniform compaction occurs since an axial feed does not take place in this compaction phase so that in the presence of a solely radial action of the tool stamps, the material and coil of the glow tube are not axially displaced.

DETAILED DESCRIPTION OF THE INVENTION

Figure 1:
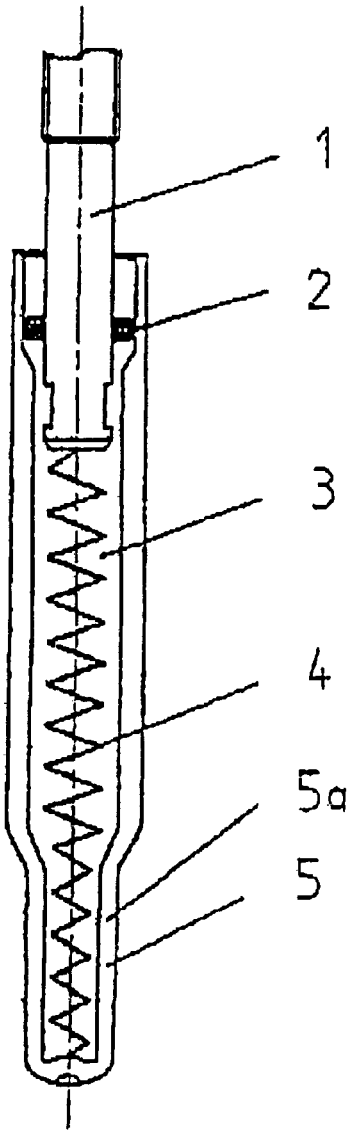
FIG. 1 PRIOR ART
FIG. 1 shows in a longitudinal section, a glow tube of a glow plug from the prior art.
Figure 2A:
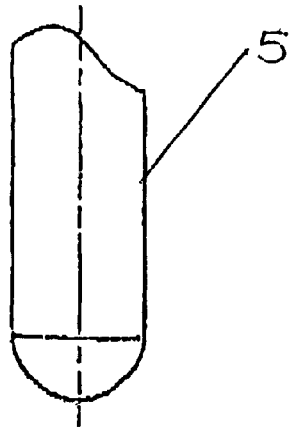
FIG. 2(a) PRIOR ART
FIGS. 2(*a*) & 2(*b*) show side and cross-sectional views, respectively, of the tip area of a conventional glow tube of FIG. 1 without additional tapering or compaction.
Figure 2B:
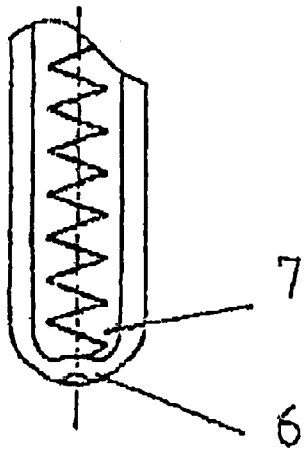
FIG. 2(b) PRIOR ART
Figure 3A:
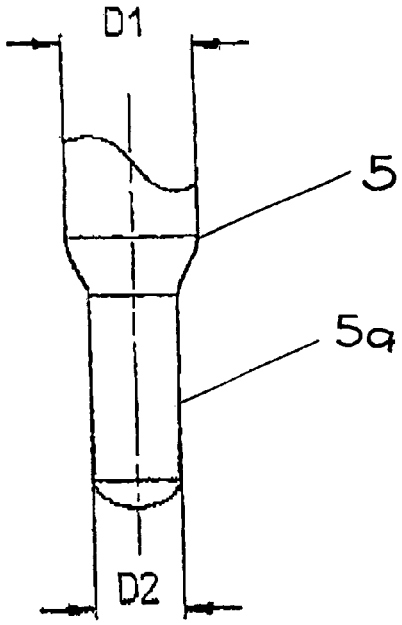
FIG. 3(a) PRIOR ART
FIGS. 3(*a*) & 3(*b*) show side and cross-sectional views, respectively, of a prior art glow rod with additional tapering of the glow rod tip.
Figure 3B:
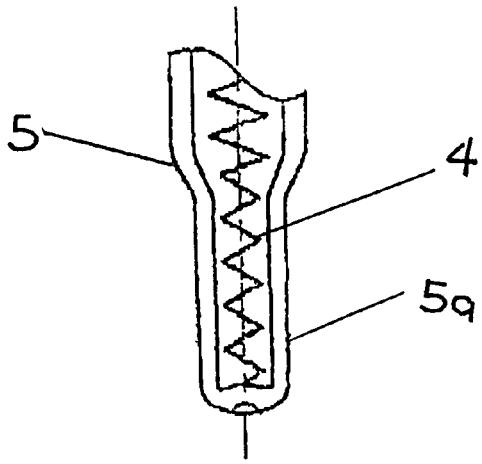
FIG. 3(b) PRIOR ART
Figure 4A:
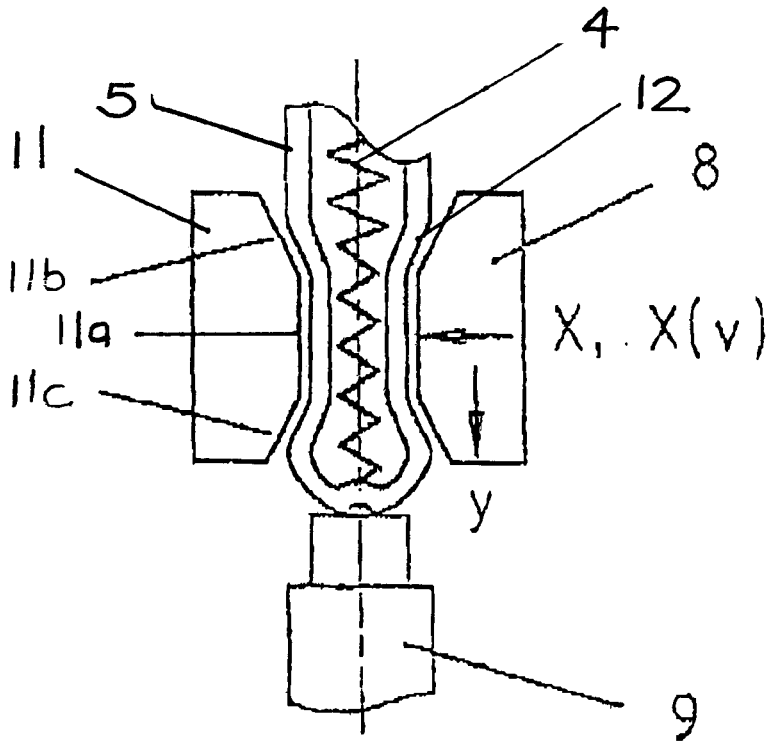
FIGS. 4(*a–d*) show a longitudinal section of the area on the combustion chamber side of a glow plug deformed or compacted according to the invention with tools for recess-kneading and another embodiment of a glow rod tip with additional tapering using a recess-kneading process.
Figure 4B:
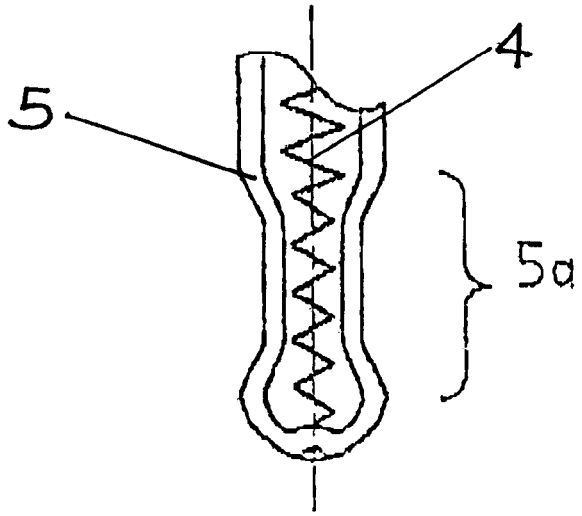
Figure 4C:
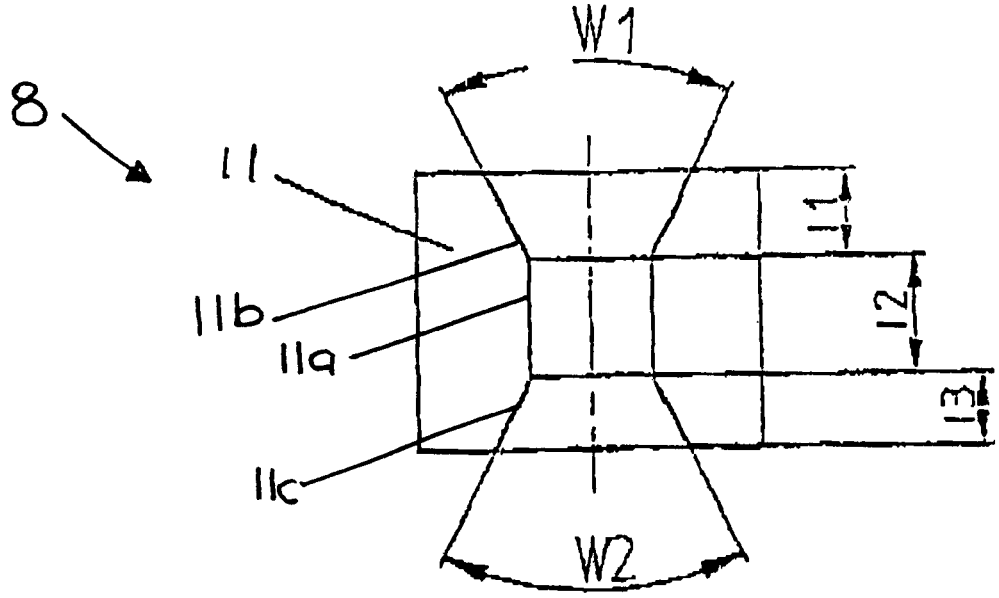
Figure 4D:
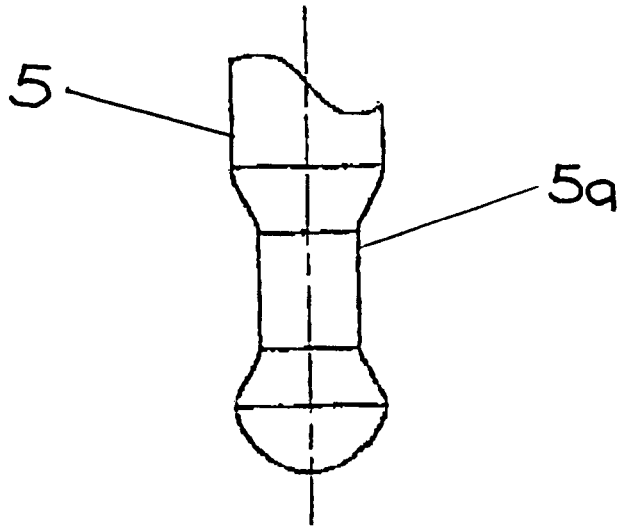

FIGS. 4(*a–d*) show a method in accordance with the invention whereby a glow tube 5 having a tip area 5*a* that is deformed on the combustion chamber side of glow tube 5. Located above the tip 5*a* area is a band-shaped neck 12. The tip 5*a* area is particularly heavily compacted and leads, due to the proximity of the glow tube wall to the heating coil 4, to the band-shaped neck 11 of particularly rapid heating when current flows through the heating coil 4.

In FIG. 4(*a*), the production process of the glow plug shown in FIG. 4(*b*) is performed using a recessing-reducing process that includes a recessing device (not shown) having a recessing tool 8. The recessing tool 8 has a tool stamp 11 having three stamp faces 11*a–c* which act on the wall of the glow tube 5. The stamp faces include a base face 11*a* and secondary stamping faces 11*b* and 11*c* that are set at an angle relative to the base stamp face 11*a*. As shown in FIG. 4(*c*) the stamp faces 11*a–c* of the recessing tool 8 have differing lengths (11, 12, 13), whereby W1 and W2 indicate the angles of the front faces with respect to the recessing direction.

The recessing tool 8 oscillates with a small stroke in direction X as in the feed process, but without any axial feed. A radial feed movement (X(v)) is superimposed on this movement whereby the diameter of the glow tube 5 at the area of the glow tube tip 5*a* is further reduced with each stroke. In this way, the area of the glow tube 5*a* is deformed according to the orientation of stamp faces 11*a–c* of the recessing tool 8. An anvil 9 prevents the material giving way in the area of the glow tube tip 5*a*. Here, the tool is beveled or rounded off in the edge areas in order to permit a certain movement of the material. Finally, the pure recessing process can be carried out in combination with the feed process, whereby the axial feed of the worked work-piece takes place in the direction indicated by the arrow. FIG. 4(*d*) shows a glow tube tip 5*a* deformed in accordance with the method of the invention described hereinabove.

Figure 5A:
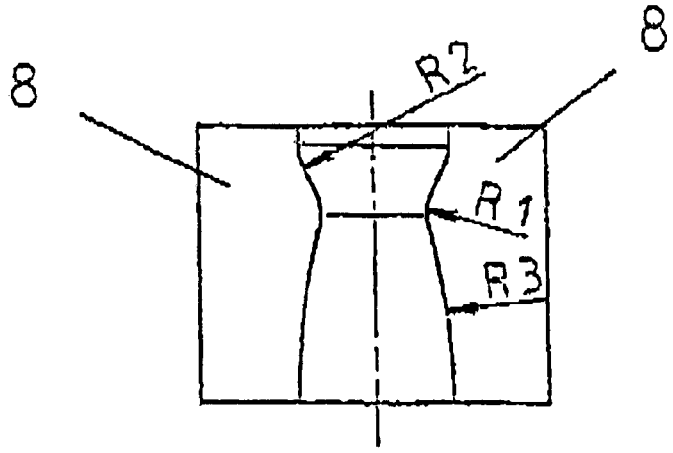
FIGS. 5(*a*) and 5(*b*) show another embodiment of a glow rod tip having additional tapering using a recess-kneading process by way of a tool having various radii of the stamp faces.
Figure 5B:
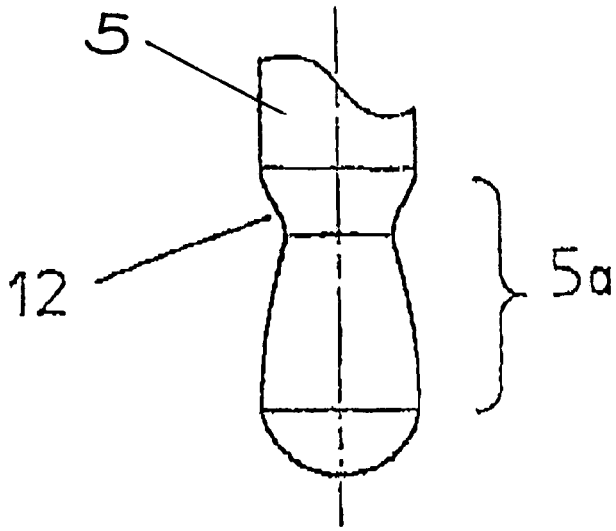

FIG. 5(*b*) shows another embodiment of a glow tube 5 having an area at the tip end 5*a* thereof on the combustion chamber side of a glow tube 5. The glow tube 5 has a groove-shaped neck portion 12 above the glow tube tip end of the glow tube 5 that is produced using the previously described recessing-reducing process. In particular, the area 5*a* lies between a tip end of the glow tube 5 and a main portion of the glow tube 5. The recessing tool 8 used to perform this process has differently curved stamp faces 11 of differing radii $R_1$, $R_2$ and $R_3$ as shown in FIG. 5(*a*).

What is claimed is:

1. A method of producing a glow plug including a glow tube with an internal heating coil which is embedded therein using a ceramic filling, said method comprising the steps of:

positioning the internal heating coil in the glow tube and surrounding the internal heating coil with the ceramic filling;

compacting the ceramic filling surrounding the internal heating coil by compacting an area on a combustion chamber side of the glow tube using a recessing-reducing process which acts on the glow tube in a radial direction.

2. A method of producing a glow plug including a glow tube with an internal heating coil which is embedded therein using a ceramic filling, said method comprising the step of:

compacting an area on a combustion chamber side of the glow tube using a recessing-reducing process which acts on the glow tube in a radial direction;

wherein the recessing-reducing process is performed using a recessing tool having a tool stamp with a plurality of stamp faces which act on a wall of the glow tube; and wherein the stamp faces comprise a base stamp face and a pair of secondary stamp faces that are set at an angle relative to the base stamp face.

3. A method of producing a glow plug including a glow tube with an internal heating coil which is embedded therein using a ceramic filling, said method comprising the step of:

compacting an area on a combustion chamber side of the glow tube using a recessing-reducing process which acts on the glow tube in a radial direction;

wherein the recessing-reducing process is performed using a recessing tool having a tool stamp with a plurality of stamp faces which act on a wall of the glow tube; and wherein the plurality of stamp faces are curved in at least one of a convex and concave manner and have different curvatures.

* * * * *